US006908564B2

(12) United States Patent
Koyama et al.

(10) Patent No.: US 6,908,564 B2
(45) Date of Patent: Jun. 21, 2005

(54) LIQUID DISCHARGE HEAD AND METHOD OF MANUFACTURING THE SAME

(75) Inventors: Shuji Koyama, Kanagawa (JP); Toshio Kashino, Kanagawa (JP); Hiroaki Mihara, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 47 days.

(21) Appl. No.: 10/418,216

(22) Filed: Apr. 18, 2003

(65) Prior Publication Data

US 2003/0197763 A1 Oct. 23, 2003

(30) Foreign Application Priority Data

Apr. 23, 2002 (JP) ..... 2002-120071

(51) Int. Cl.[7] ..... B41J 2/04

(52) U.S. Cl. ..... 216/27; 216/17; 438/21; 427/585; 347/65

(58) Field of Search ..... 216/17, 27; 427/585; 438/21; 347/65

(56) References Cited

U.S. PATENT DOCUMENTS

| | | | | | |
|---|---|---|---|---|---|
| 4,343,013 | A | * | 8/1982 | Bader et al. | 347/47 |
| 4,961,821 | A | * | 10/1990 | Drake et al. | 438/21 |
| 6,196,667 | B1 | * | 3/2001 | Hiroki et al. | 347/65 |
| 6,199,972 | B1 | | 3/2001 | Ishinaga et al. | 347/65 |
| 6,206,505 | B1 | | 3/2001 | Yoshihira et al. | 347/48 |
| 6,206,508 | B1 | | 3/2001 | Asakawa et al. | 347/65 |
| 6,254,215 | B1 | | 7/2001 | Hiroki et al. | 347/20 |
| 6,312,111 | B1 | | 11/2001 | Kimura et al. | 347/65 |
| 6,334,669 | B1 | | 1/2002 | Kudo et al. | 347/65 |
| 6,378,993 | B1 | | 4/2002 | Ozaki et al. | 347/65 |
| 6,464,342 | B1 | | 10/2002 | Kubota et al. | 347/63 |
| 6,491,380 | B2 | | 12/2002 | Taneya et al. | 347/65 |
| 6,569,343 | B1 | | 5/2003 | Suzuki et al. | 216/27 |
| 2003/0030701 | A1 | | 2/2003 | Sugiyama et al. | 347/65 |
| 2003/0038108 | A1 | | 2/2003 | Koyama et al. | 216/27 |

* cited by examiner

*Primary Examiner*—Shamim Ahmed
(74) *Attorney, Agent, or Firm*—Fitzpatrick, Cella, Harper & Scinto

(57) ABSTRACT

Patterning is performed to thermal oxide films 12*a* and 12*b* formed on both surface sides of a silicon substrate in which crystal orientation of a surface is (100) or (110), a liquid chamber pattern and a liquid supplying port pattern are formed, and a liquid chamber and a liquid supplying port are formed separately by anisotropically etching the silicon substrate from both surface sides at the same time. Then, a silicon nitride film is deposited with a low pressure chemical vapor deposition to both surface sides of the silicon substrate and all faces of the liquid chamber and the liquid supplying port which are formed by etching. As a result, when the silicon substrate is used for a top plate, stiffness of the top plate is improved, design freedom of the liquid chamber and the liquid supplying port is increased, misalignment is prevented in bonding to the substrate, degradation of ejecting performance is prevented, and a liquid discharge head having high preciseness and high reliability can be provided.

15 Claims, 7 Drawing Sheets

LIQUID DISCHARGE HEAD AND METHOD OF MANUFACTURING THE SAME

BACKGROUND OF THE INVENTION

1. Field of the Invention

The present invention relates to a liquid discharge head which ejects (discharges) a droplet to adhere to a recording medium and performs printing, image formation, or the like, and a method of manufacturing the same.

2. Related Background Art

The liquid discharge method (inkjet recording method) includes plural orifices ejecting a liquid such as ink, plural liquid channels which are communicated with each orifice, and plural discharge energy generating elements which are arranged in each liquid channel. The liquid discharge method is one of non-impact recording methods in which ejecting energy is given to the liquid by applying a driving signal to the discharge energy generating element and the printing, the image formation, or the like is performed by ejecting the liquid from the orifice. The liquid discharge method is characterized in that high-speed recording can be performed with a low noise level and fine image can be obtained at a low cost. Further, such kind of liquid discharge method can perform the printing, the image formation, or the like to recording media such as paper, string, fiber, cloth, leather, metal, plastic, glass, wood, and ceramic. The liquid discharge method can be applied to printers as a peripheral of a computer, printing systems such as a copying machine, a facsimile having a communication system, and a word processor, and industrial recording devices combined with various kinds of processing devices, and the liquid discharge method is rapidly becoming widespread in recent years. For such kind of liquid discharge method, there have been proposed and improved various methods in which some of them are available in the market and some of them are under development.

For example, as shown in FIG. 7, the liquid discharge head in such kind of liquid discharge method includes an element substrate 202 having an energy generating element (heating element) 202 which generates the ejecting energy to the liquid, a top plate 203 which has a liquid chamber (not shown) storing the liquid and a liquid supplying port 205 supplying the liquid to the liquid chamber and forms liquid channels 204 by being bonded to the element substrate 201, and an orifice plate 206 having fine orifices 207 for ejecting the liquid.

The top plate 203 is essential to form the liquid channel 204, and the top plate 203 is the important element affecting ejecting performance of the liquid discharge head. That is, various proposals have been made for the top plate 203 of the liquid discharge head, in which good bonding properties and precise structure are required in order to prevent crosstalk of each liquid channel and to keep the ejecting speed constant.

When the top plate is formed by using a silicon material in the prior art, the top plate is produced through a step shown in FIGS. 8A to 8F and 9A to 9F.

FIGS. 8A to 8F show a step of manufacturing the top plate used for a single color liquid discharge head. FIGS. 8D to 8F are sectional views taken on line 8D—8D of FIG. 8A, line 8E—8E of FIG. 8B, and line 8F—8F of FIG. 8C respectively. Thermal oxide films 112*a* and 112*b* are formed on a surface on the side where a liquid chamber 115 is formed (hereinafter referred to as liquid chamber surface) and the surface on the side where a liquid supplying port 116 is formed (hereinafter referred to as liquid supplying port surface) respectively in a silicon substrate 111 shown in a chip state. As shown in FIGS. 8A and 8D, patterning is performed to the thermal oxide film 112*a* on the liquid chamber surface side by photolithography to form a liquid chamber pattern 113. Then, the patterned silicon substrate 111 is etched by an anisotropic etching technique to make a hole through the silicon substrate 111, as shown in FIGS. 8B and 8E. An aqueous TMAH (tetramethyl ammonium hydroxide) solution (for example, TMAH-22 which is a product of Kanto Kagaku) is used as the etching solution for the anisotropic etching, and the through hole is made by the etching though the silicon substrate 111 having a thickness of 625 $\mu$m. Then, by removing the thermal oxide films 112*a* and 112*b* with wet etching, as shown in FIGS. 8C and 8F, the liquid chamber surface side of the through hole in the silicon substrate 111 becomes the liquid chamber 115, the opposite surface of the through hole becomes the liquid supplying port 116, and a top plate 110 used for the single color liquid discharge head is produced.

FIGS. 9A to 9F show a step of manufacturing a top plate used for a three-color liquid discharge head. FIGS. 9A to 9C are sectional views taken on line 9A—9A of FIG. 9D, line 9B—9B of FIG. 9E, and line 9C—9C of FIG. 9F respectively. The thermal oxide films 112*a* and 112*b* are formed on the liquid chamber surface and the liquid supplying port surface of the silicon substrate 111 shown in the chip state. As shown in FIGS. 9A and 9D, the patterning is performed to the thermal oxide film 112*a* on the liquid chamber surface side by the photolithography to form the three liquid chamber patterns 113. Then, in the same way as described above, the patterned silicon substrate 111 is etched by the anisotropic etching technique to make the hole through the silicon substrate 111, as shown in FIGS. 9B and 9E. Then, by removing the thermal oxide films 112*a* and 112*b* with the wet etching, as shown in FIGS. 9C and 9F, the liquid chamber surface side of the three through holes in the silicon substrate 111 becomes the liquid chambers 115, the opposite surface of the three through holes becomes each liquid supplying port 116 which communicates with each liquid chamber 115, and the top plate 110 used for the three-color liquid discharge head is produced.

The high-speed and fine recording is required as recording technology progresses in recent years, so that weight reduction is required and the smaller top plate is formed in the liquid discharge head. In order to be adapted for various kinds of ink, it is necessary not to expose the ink to faces of the silicon as much as possible. Further, it is necessary to provide an alignment mark for performing electric connection and increasing adhesive properties between a liquid supplying member and the top plate, which supplies the liquid (ink) to the liquid chamber in the top plate after the top plate is bonded to the element substrate, to improve prevention of color mixing.

However, as shown in FIGS. 8A to 8F and FIGS. 9A to 9F, in the case of the method in which the liquid chamber is formed on the silicon substrate to form the top plate, the hole of the liquid supplying port is decreased as a size of the top plate is decreased, so that the sufficient amount of liquid can not be obtained for the high-speed printing. When the liquid chamber is enlarged by decreasing the size of the top plate, stiffness of the top plate is reduced, as a result, lifting of the top plate or the crosstalk occurs when the top plate is bonded to the element substrate. Since the pattern can not be formed on an upper portion of the top plate, a problem is created such that the alignment mark for the electric connection and improvement of adhesive properties of the liquid supplying member supplying the liquid can not be also formed. There is also the problem that the ink reacts with the silicon in the case of only the etching plane (111) of the silicon and the silicon is dissolved to generate kogation in the heating element (heater) because the liquid discharge head is used for various kinds of ink.

In the case of a full-line head in which the plural orifices (ejecting port) are arranged over recordable region of the recording medium, since the stiffness of the top plate is reduced, warping is generated between the top plate and the element substrate and the top plate, where the discharge energy generating elements are arranged, which results in displacement between the top plate and the element substrate. As a result, the bonding is not successful and the ejecting performance is affected.

SUMMARY OF THE INVENTION

In view of the foregoing, it is an object of the invention to provide a liquid discharge head, in which the stiffness of the top plate and design freedom of the liquid chamber and the liquid supplying port are improved, the displacement between the element substrate and the top plate can be prevented in the bonding, degradation of the ejecting (discharge) performance is prevented, the accuracy is high, and reliability is high when the silicon substrate is used for the top plate.

In order to achieve the above-described object, a liquid discharge head of the invention comprises a first substrate in which a discharge energy generating element for ejecting a liquid is arranged and a liquid channel wall dividing a liquid channel for guiding the liquid is formed and a second substrate in which a liquid chamber storing the liquid is formed on one surface thereof and a liquid supplying port receiving the liquid supplied to the liquid chamber is formed on the other surface thereof, the first substrate and the second substrate being bonded, wherein the liquid chamber differs from the liquid supplying port in a shape, the liquid chamber and the liquid supplying port are formed at one time from both surface sides of the second substrate.

A method of manufacturing a liquid discharge head of the invention, having a first substrate in which discharge energy generating elements for ejecting a liquid are arranged and a liquid channel wall dividing a liquid channel for guiding the liquid is formed and a second substrate in which a liquid chamber storing the liquid is formed on one surface thereof and a liquid supplying port receiving the liquid supplied to the liquid chamber is formed on the other surface thereof, the first substrate and the second substrate being bonded, the method of comprising a step of forming the liquid chamber and the liquid supplying port at one time from both surface sides of the second substrate.

In the liquid discharge head of the invention and the method of manufacturing the same, it is preferable that a material of the second substrate is silicon and the liquid chamber and the liquid supplying port are formed by etching, and it is preferable that crystal orientation of the surface is (100) or (110) in the second substrate.

In the liquid discharge head of the invention and the method of manufacturing the same, it is preferable that they comprises a step of coating the second substrate with an ink resistance film formed by a chemical vapor deposition (CVD) method after the step of forming the liquid chamber and the liquid supplying port of the second substrate at one time from the both surface sides of the second substrate.

In the liquid discharge head of the invention and the method of manufacturing the same, a plurality of grooves may be formed on the liquid supplying port surface of the second substrate, the plurality of liquid supplying ports may be formed on the second substrate, and the plurality of grooves may be formed between the adjacent liquid supplying ports. Also, in the method of manufacturing a liquid discharge head of the invention, an alignment mark for electric connection may be formed on the surface where the liquid supplying port is formed in the second substrate.

According to the liquid discharge head of the invention and the method of manufacturing the same, the top plate having the high stiffness can be precisely produced by forming the liquid chamber and the liquid supplying port of the top plate (second substrate) at one time from both surface sides of the substrate. Further, various kinds of liquids (ink) can be used by coating the second substrate by the chemical vapor deposition (CVD) method after the liquid chamber and the liquid supplying port are formed at one time from both surface sides of the substrate.

By forming the liquid chamber and the liquid supplying port with the etching at one time from both surface sides of the silicon substrate, design freedom of the liquid chamber and the liquid supplying port is increased, the stiffness of the top plate can be improved, preciseness of alignment can be improved in bonding to the substrate or connection of the liquid supplying member, degradation of the ejecting performance can be prevented, and the liquid discharge head having high reliability and high preciseness can be obtained. Since the top plate of the invention has high stiffness, even if the top plate is used for the full line head, the warp never occurs in the top plate, misalignment can be prevented in the bonding, and the degradation of ejecting performance can be prevented. Consequently, the liquid discharge head, in which crosstalk never occurs and the ejecting performance is stable, can be obtained.

The liquid discharge head having the high preciseness and the high reliability can be provided in such a manner that the alignment mark for the electric connection or the bonding groove of the liquid supplying member is formed with the liquid supplying port at one time on the liquid supplying port surface side of the top plate.

Further, in the liquid discharge head of the invention, it is preferable that a movable member is provided on the first substrate and the movable member is located so as to oppose the discharge energy generating element, and it is preferable that an upward displacement control member which controls upward displacement of the movable member is formed in the liquid channel.

DETAILED DESCRIPTION OF THE PREFERRED EMBODIMENTS

Preferred embodiments of the invention will be described below referring to the accompanying drawings.

Figure 1:
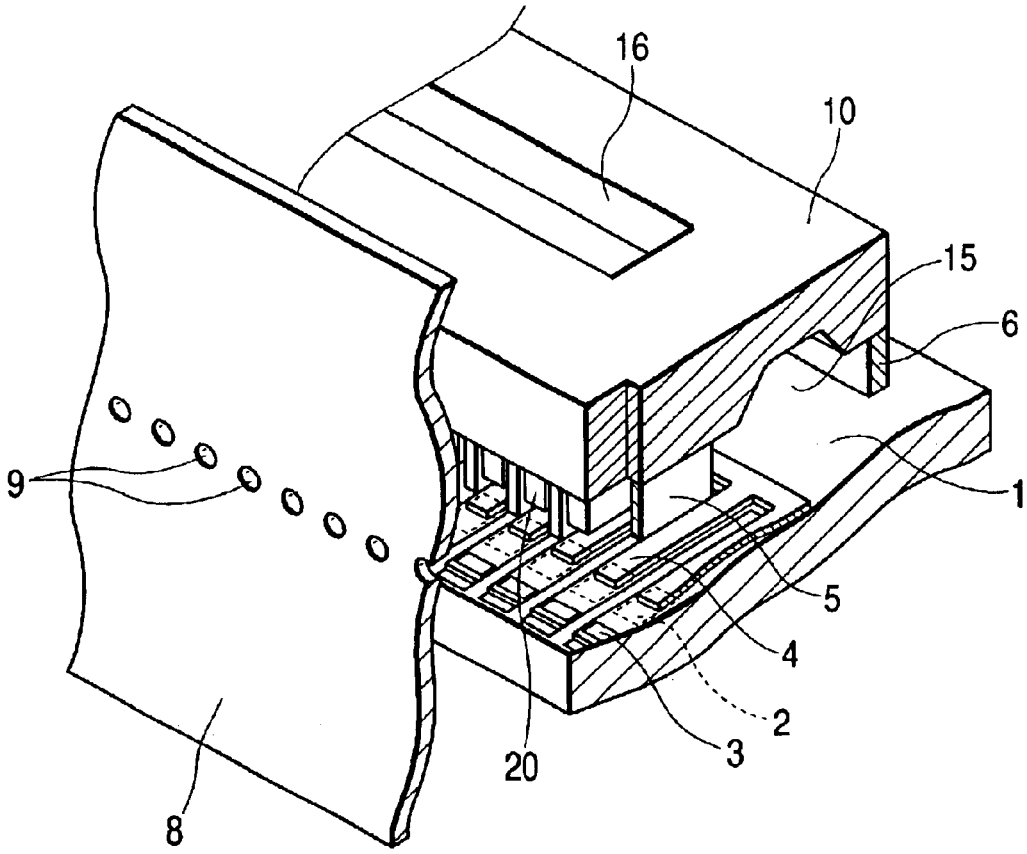
FIG. 1 is a schematically perspective view, partly broken away to show an embodiment of a liquid discharge head according to the invention.
Figure 2:
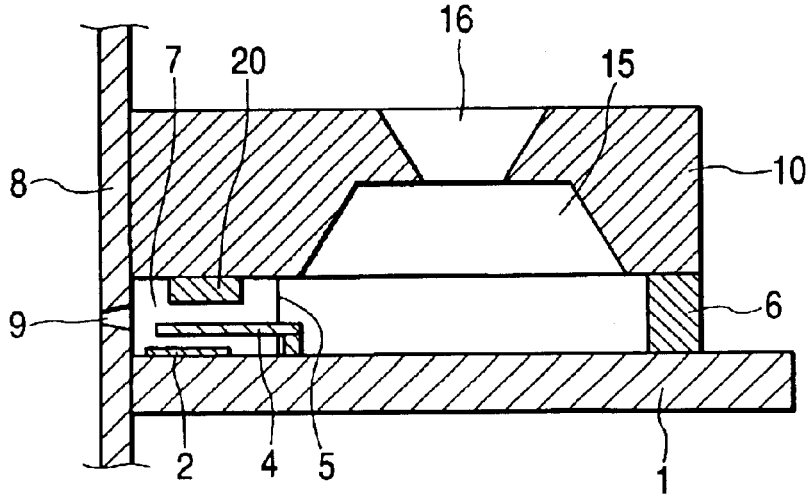
FIG. 2 is a schematically sectional view of the embodiment of the liquid discharge head according to the invention.

FIG. 1 is a schematically perspective view, partly broken away to show an embodiment of the liquid discharge head according to the invention, FIG. 2 is a schematically sectional view of the embodiment of the liquid discharge head according to the invention, and FIGS. 3A to 3H is a view showing a step of manufacturing a top plate used for a single color liquid discharge head in the embodiment of the liquid discharge head according to the invention. FIGS. 3E to 3H are sectional views taken on line 3E—3E of FIG. 3A, line 3F—3F of FIG. 3B, line 3G—3G of FIG. 3C, and line 3H—3H of FIG. 3D respectively.

First of all the top plate used for single color liquid discharge head of the embodiment will be described referring to FIGS. 3A to 3H showing its manufacturing step.

Figure 3A:
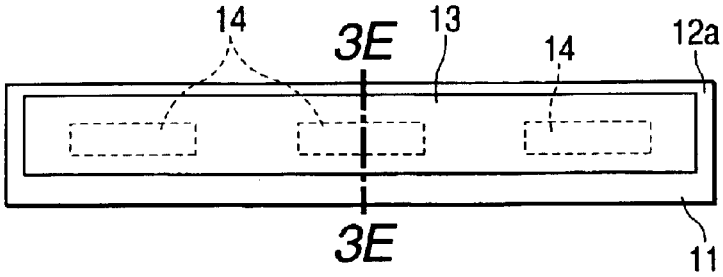
FIGS. 3A, 3B, 3C, 3D, 3E, 3F, 3G and 3H show a step of manufacturing a top plate used for a single color liquid discharge head in the embodiment of the liquid discharge head according to the invention.
Figure 3E:
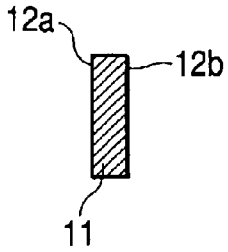
Figure 3B:
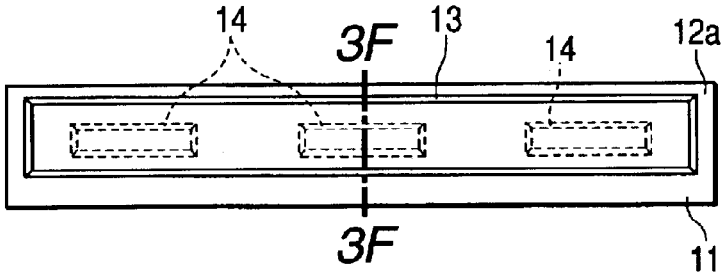
Figure 3F:
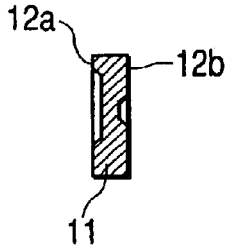
Figure 3C:
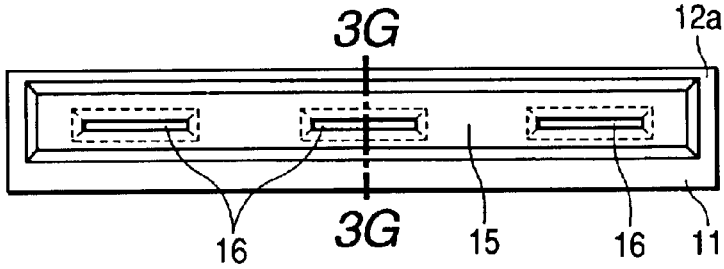
Figure 3G:
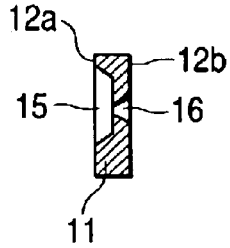

In FIGS. 3A to 3H, thermal oxide films 12*a* and 12*b* are formed on a surface on the side where a liquid chamber 15 is formed (hereinafter referred to as liquid chamber surface) and the surface on the side where a liquid supplying port 16 is formed (hereinafter referred to as liquid supplying port surface) respectively in a silicon substrate 11 shown in a chip state in which both surface sides are polished to a mirror surface. Then, as shown in FIGS. 3A and 3E, the patterning is performed to the thermal oxide films 12*a* and 12*b* by the photolithography to form one liquid chamber pattern 13 on the liquid chamber surface and liquid supplying port patterns 14 (though three liquid supplying ports are provided in FIGS. 3A to 3H, the number of liquid supplying ports can be properly set) on the liquid supplying port surface respectively. In the patterning method, after the patterning is performed to one of the surfaces, the patterning is easily performed on the opposite surface by aligning the alignment mark of a mask and the alignment mark of the patterned surface with image recognition in a double-sided aligner (for example, MA6 which is a product name of Karl Suss). As shown in FIGS. 3A and 3E, the patterned silicon substrate 11 is obtained in such a manner that the patterning of the liquid chamber pattern 13 is performed on one of the surfaces and the patterning of the liquid supplying port pattern 14 is performed on the other surface. FIGS. 3B and 3F show the state in which the patterned silicon substrate 11 is half-etched by using the aqueous TMAH (tetramethyl ammonium hydroxide) solution (for example, TMAH-22 which is a product of Kanto Kagaku) as the etching solution. A temperature is set to 80° C. and a TMAH concentration is set to 22% in etching conditions. In such etching, when surface crystal orientation of the silicon substrate 11 is (100), the etching progresses with an angle of 54.7°, and the surface having the crystal orientation (111) remains finally as the surface which is not etched. As described above, when the anisotropic etching is performed in the silicon substrate in which the patterning of the different patterns of the liquid chamber pattern 13 and the liquid supplying port pattern 14 is performed, the etching progresses from both sides of the liquid chamber pattern 13 of the liquid chamber and the liquid supplying port pattern 14 of the liquid supplying port, and pierces the silicon substrate 11. Consequently, the holes having a shape shown in FIGS. 3C and 3G are made. The etching is performed by using TMAH-22, which is the product of Kanto Kagaku, as the etching solution, and the etching pierces through the silicon substrate 11 having the thickness of 625 $\mu$m. In the silicon substrate 11 produced by the above-described way, as shown in FIGS. 3C and 3G, the liquid chamber 15 and the liquid supplying port 16 are formed at different positions. The liquid chamber 15 is etched to only a half degree compared with the prior art, so that the liquid chamber 15 and the liquid supplying port 16 can be provided at an arbitrary position and the stiffness of the silicon substrate 11 can be also increased. The liquid chamber 15 and the liquid supplying port 16, which have appropriate shapes different from each other, are formed on the silicon substrate in such a manner that the patterning of the liquid chamber pattern 13 and the liquid supplying port pattern 14 is performed with the appropriate shape.

The liquid chamber and the liquid supplying port can be also formed respectively in such a manner that the above-described anisotropic etching is performed with the silicon substrate having the surface crystal orientation (110).

Figure 3D:
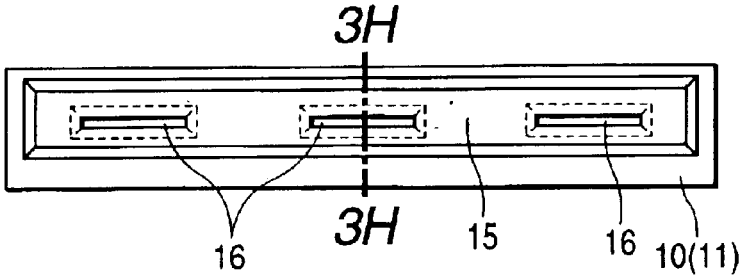
Figure 3H:
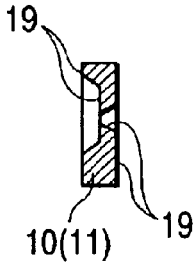

After the thermal oxide films 12*a* and 12*b* of the silicon substrate 11, in which the anisotropic etching is completed, are removed by the wet etching, as shown in FIGS. 3D and 3H, a silicon nitride film 19 is deposited to the both surfaces of the silicon substrate 11 and all faces of the liquid chamber 15 and the liquid supplying port 16, which are formed by the etching, with the low pressure chemical vapor deposition method (LPCVD). As described above, various kinds of ink can be used by coating the surfaces of the silicon substrate 11 with a material having ink resistance.

The liquid discharge head in which the silicon substrate 11 formed in the above-described way is built in as the top plate 10 will be described below referring to FIGS. 1 and 2.

In the element substrate 1, the plural heating elements 2 (electrothermal energy conversion element) as the discharge energy generating element and plural Al leads 3 for supplying an electric signal to the heating element 2 are formed on the silicon substrate by a semiconductor process, a movable member 4 is provided above the heating element 2 so as to correspond to each heating element 2. Plural liquid channel walls 5 for forming the liquid channel corresponding to each of the plural heating elements 2 are formed by performing the patterning after a photosensitive resin layer is laminated on the element substrate 1. In the same way, a liquid chamber frame 6 is formed simultaneously on the element substrate 1.

The top plate 10 is bonded to the element substrate 1 in which various parts are formed in the above-described way. As described above, the liquid chamber 15 and the liquid supplying port 16 are formed in the top plate 10, and an upward displacement control member 20 which controls the upward displacement of the movable member 4 is formed corresponding to the movable member 4. The upward displacement control member 20 can be formed by performing the patterning after the photosensitive resin is formed by application or lamination at the position corresponding to the movable member 4 of the liquid chamber surface of the top plate 10. The top plate 10 is aligned with the alignment mark, bonded to the liquid channel wall 5 and the liquid chamber frame 6 through an adhesive, and combined with the element substrate 1. An epoxy adhesive, in which cure shrinkage is finished by becoming B-stage with UV irradiation while tacking properties are held and the curing occurs by heating, is used as the adhesive. In the epoxy adhesive, the bonding can be also performed only by thermo-compression bonding. The epoxy adhesive is transferred with heat to the liquid channel wall 5 and the liquid chamber frame 6, the adhesive is activated with UV irradiation, and then the top plate 10 is bonded to the element substrate 1 by the thermo-compression bonding. A head body, in which a liquid channel 7 is formed, is produced by bonding the element substrate 1 and the top plate 10.

An orifice plate 8, in which an orifice 9 ejecting the liquid is formed, is aligned so that the orifice 9 corresponds to the liquid channel 7, and bonded to the opened surface of the liquid channel 7 of the head body through the adhesive, and then the liquid discharge head is completed.

In the liquid discharge head which is constructed in the above-described way, when the heating element 2 is driven to be heated, the heat acts on the liquid (ink) between the heating element 2 and the movable member 4 and a bubble is generated on the basis of a boiling phenomenon. Pressure caused by growth of the bubble acts on the movable member 4 to largely displace a free end portion. Propagation of the pressure caused by the generation of the bubble and the growth of the bubble itself are guided to the orifice 9 side by the displacement of the movable member 4 and the liquid is efficiently ejected from the orifice 9. Ejecting performance such as ejecting efficiency or ejecting speed of the liquid can be improved by providing the movable member 4. The unnecessary displacement of the movable member 4 can be blocked by providing the upward displacement control member 20 which controls the upward displacement of the movable member 4 in the top plate 10. When the heating element 2 stops driving and the heating is finished, the bubble starts vanishing and the movable member 4 rapidly returns to the initial state during the vanishing of the bubble. At this point, in order to refill a volume of the ejected liquid, the liquid flows from the liquid chamber 15 to perform the refilling of the liquid, and the stably refilling is efficiently and rationally performed by the rapid returning action of the movable member 4.

As described above, when the printing is performed by using the liquid discharge head which is produced in such a manner that the top plate 10 formed by the embodiment is bonded to the element substrate 1 and the orifice plate 8 is bonded, the top plate 10 is not peeled off, the crosstalk never occurs, misdirection or nonuniformity of the printing is not generated, the good printing is obtained, and stable ejecting characteristics can be achieved. Further, when the liquid discharge head is disassembled, the top plate 10 and the liquid channel wall 5 are completely bonded.

Another embodiment of the liquid discharge head according to the invention will be described below referring to FIGS. 4A to 4H. FIGS. 4A to 4H show a step of manufacturing a top plate used for a three-color liquid discharge head in the embodiment. FIGS. 4A to 4D are sectional views taken on line 4A—4A of FIG. 4E, line 4B—4B of FIG. 4F, line 4C—4C of FIG. 4G, and line 4D—4D of FIG. 4H respectively.

At first, the top plate used for the three-color liquid discharge head in the embodiment will be described referring to FIGS. 4A to 4H showing the step of manufacturing the top plate. The same member as that used in the above-described embodiment is indicated by the same reference numeral in this embodiment.

Figure 4A:
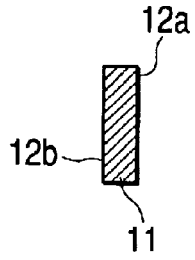
FIGS. 4A, 4B, 4C, 4D, 4E, 4F, 4G and 4H show a step of manufacturing a top plate used for a three-color liquid discharge head in another embodiment of the liquid discharge head according to the invention.
Figure 4E:
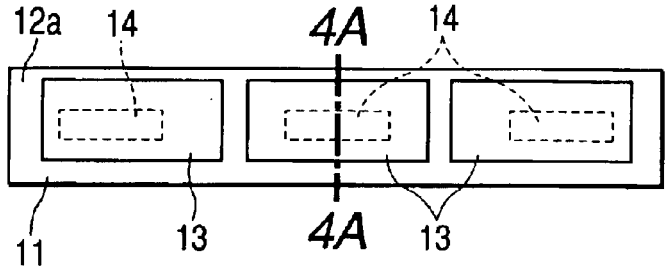
Figure 4B:
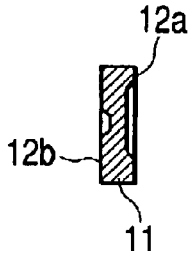
Figure 4F:
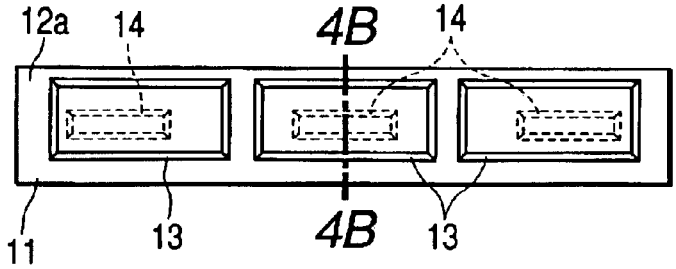
Figure 4C:
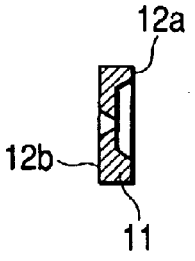
Figure 4G:
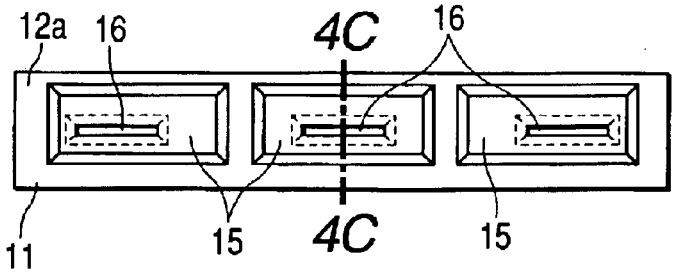

In FIGS. 4A to 4H, the thermal oxide films 12*a* and 12*b* are formed on the liquid chamber surface and the liquid supplying port surface respectively in the silicon substrate 11 shown in the chip state in which both surface sides are polished to the mirror surface. Then, as shown in FIGS. 4A and 4E, the patterning is performed to the thermal oxide films 12*a* and 12*b* by the photolithography, and the three liquid chambers patterns 13 and the three liquid supplying port patterns 14 are formed on the liquid chamber surface and the liquid supplying port surface respectively so that the three liquid chambers patterns 13 are placed in superposed relation with the three liquid supplying port patterns 14. The patterning method can be formed in the same way as the above-described embodiment. FIGS. 4B and 4F show the state in which the patterned silicon substrate 11 shown in FIGS. 4A and 4E is half-etched by using the etching solution, e.g., TMAH-22 which is the product of Kanto Kagaku. The temperature is set to 80° C. and the TMAH concentration is set to 22% in the etching conditions. In such etching, when the surface crystal orientation of the silicon substrate 11 is (100), the etching progresses with the angle of 54.7°, and the surface having the crystal orientation (111) remains finally as the surface which is not etched. As described above, when the anisotropic etching is performed in the silicon substrate in which the patterning of the different patterns of the liquid chamber pattern 13 and the liquid supplying port pattern 14 is performed, the etching progresses from both sides of the liquid chamber pattern 13 of the liquid chamber and the liquid supplying port pattern 14 of the liquid supplying port, and pierces the silicon substrate 11. Consequently, the holes having the shape shown in FIGS. 4C and 4G are made. The etching is performed by using TMAH-22, which is the product of Kanto Kagaku, as the etching solution, and the etching pierces though the silicon substrate 11 having the thickness of 625 $\mu$m. In the silicon substrate 11 produced by the above-described way, as shown in FIGS. 4C and 4G, the three liquid supplying ports 16, which are communicated with the three liquid chambers 15 respectively, are formed, and the liquid chamber 15 and the liquid supplying port 16 are separately formed. Further, the liquid chamber 15 is etched to only the half degree compared with the prior art, so that the liquid chamber 15 and the liquid supplying port 16 can be provided at an arbitrary position and the stiffness of the silicon substrate 11 can be also increased.

Figure 4D:
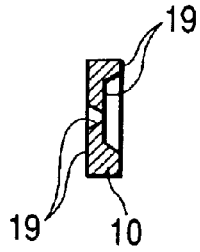
Figure 4H:
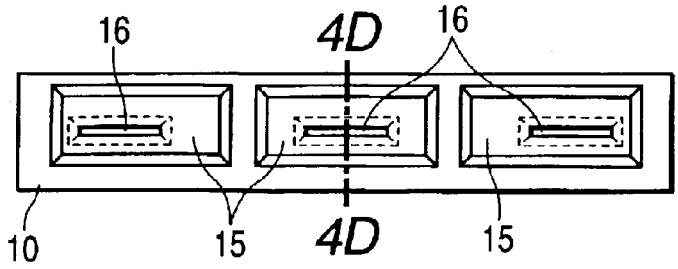

After the thermal oxide films 12*a* and 12*b* of the silicon substrate 11, in which the anisotropic etching is completed, are removed by the wet etching, as shown in FIGS. 4D and 4H, the silicon nitride film 19 is deposited to the both surfaces of the silicon substrate 11 and all faces of the liquid chamber 15 and the liquid supplying port 16, which are formed by the etching, with the low pressure chemical vapor deposition method (LPCVD). As described above, various kinds of ink can be used by coating the surfaces of the silicon substrate 11 with the material having ink resistance.

In the same way as the above-described embodiment, the silicon substrate 11 having the three liquid chambers 15 and the three liquid supplying ports 16, which are formed in the above-described way, is used as the top plate 10 and built in the three-color liquid discharge head, and then the liquid discharge head can be completed. That is, similarly to the liquid discharge head shown in FIG. 1, the silicon substrate 11 having the liquid chamber 15 divided into three chambers is used as the top plate 10 and bonded to the element substrate 1, and the three-color liquid discharge head is completed by bonding the orifice plate 8. When the printing is performed by using the liquid discharge head which is produced in the above-described way, the top plate is not peeled off, the crosstalk never occurs, misdirection or non-uniformity of the printing is not generated, the good printing is obtained, and stable ejecting characteristics can be achieved. Further, when the liquid discharge head is disassembled, the top plate 10 and the liquid channel wall 5 are completely bonded.

Figure 5A:
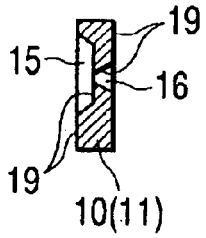
FIGS. 5A and 5B show the top plate used for the single color liquid discharge head in still another embodiment of the liquid discharge head according to the invention.
Figure 5B:
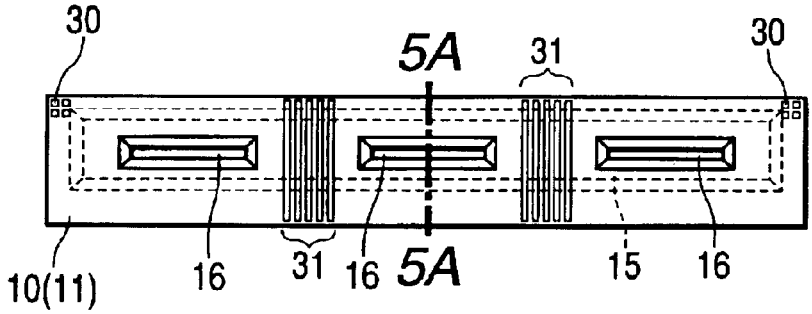
Figure 6A:
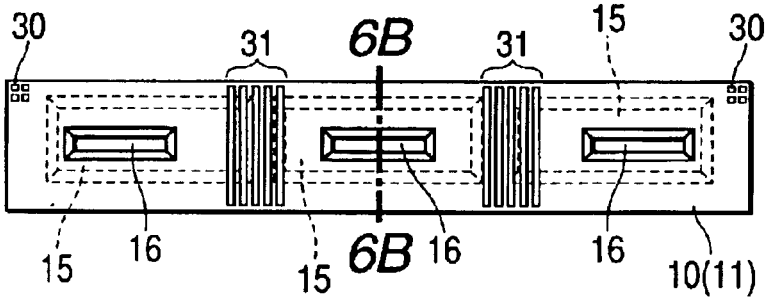
FIGS. 6A and 6B show the top plate used for the three-color liquid discharge head in still another embodiment of the liquid discharge head according to the invention.
Figure 6B:
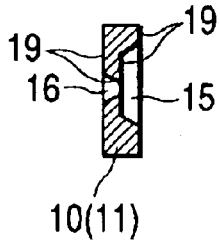
Figure 7:
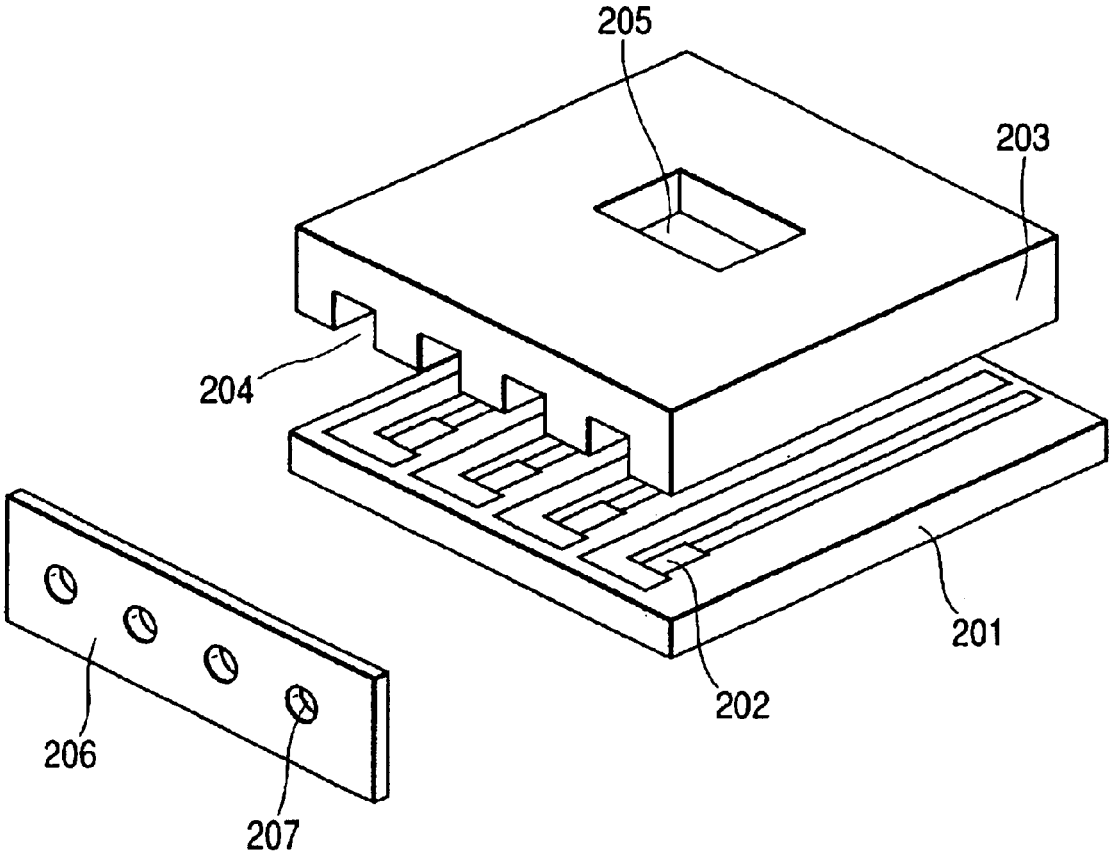
PRIOR ART FIG. 7
FIG. 7 is a perspective view showing a schematic configuration of a conventional liquid discharge head.
Figure 8A:
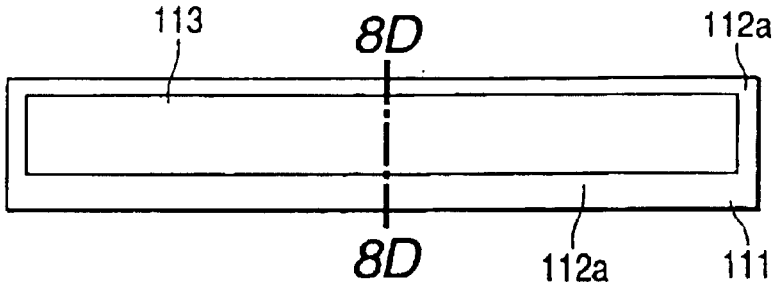
PRIOR ART FIG. 8A
FIGS. 8A, 8B, 8C, 8D, 8E and 8F show a step of manufacturing a top plate used for a conventional single color liquid discharge head.
Figure 8D:
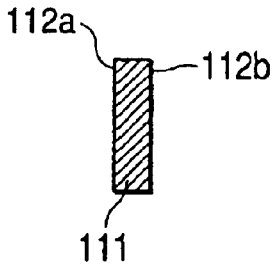
PRIOR ART FIG. 8D
Figure 8B:
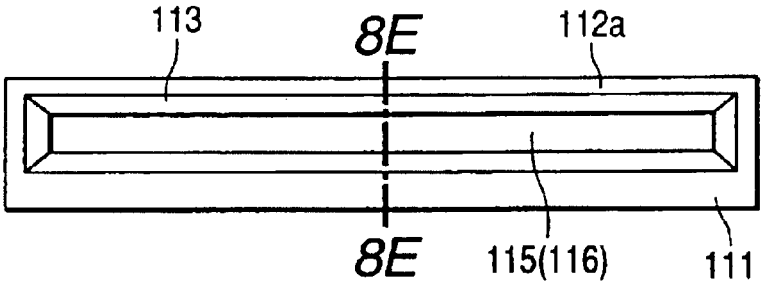
PRIOR ART FIG. 8B
Figure 8E:
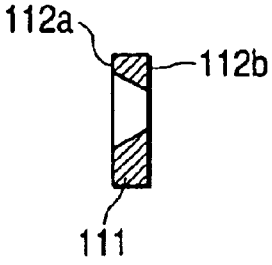
PRIOR ART FIG. 8E
Figure 8C:
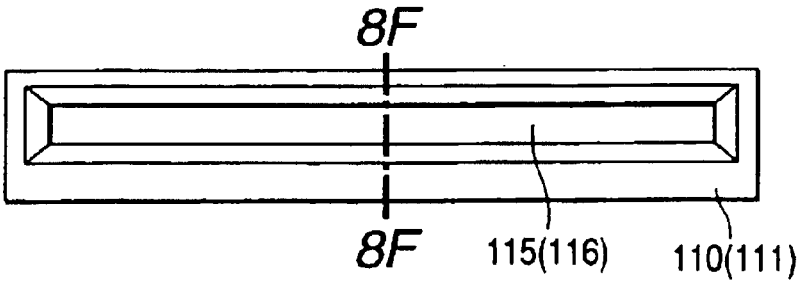
PRIOR ART FIG. 8C
Figure 8F:
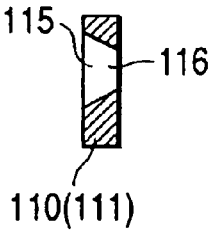
PRIOR ART FIG. 8F
Figure 9A:
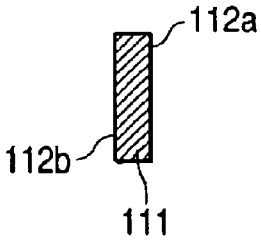
PRIOR ART FIG. 9A
FIGS. 9A, 9B, 9C, 9D, 9E and 9F show a process of manufacturing a top plate used for a conventional three-color liquid discharge head.
Figure 9D:
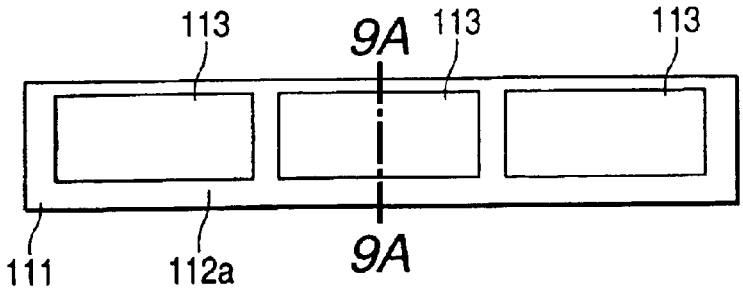
PRIOR ART FIG. 9D
Figure 9B:
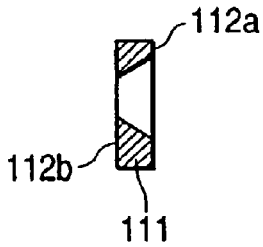
PRIOR ART FIG. 9B
Figure 9E:
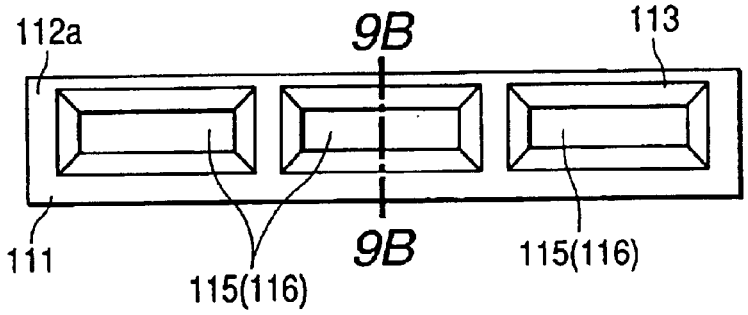
PRIOR ART FIG. 9E
Figure 9C:
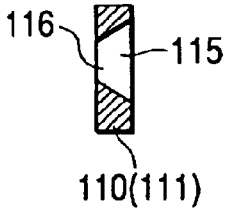
PRIOR ART FIG. 9C
Figure 9F:
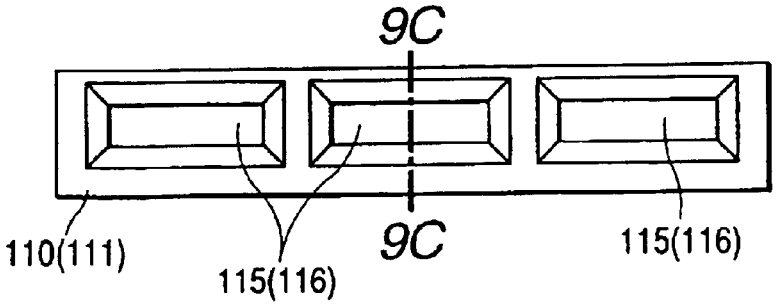
PRIOR ART FIG. 9F

Still another embodiment of the liquid discharge head according to the invention will be described below referring to FIGS. 5A, 5B, 6A and 6B. FIGS. 5A and 5B show the top plate used for the single color liquid discharge head in the embodiment, and FIG. 5A is a sectional view taken on line 5A—5A of FIG. 5B. FIGS. 6A and 6B show the top plate used for the three-color liquid discharge head in the embodiment, and FIG. 6B is a sectional view taken on line 6B—6B of FIG. 6A.

The top plate used for the liquid discharge head in the embodiment will be described referring to FIGS. 5A, 5B, 6A and 6B. The same member as that used in the above-described embodiments is also indicated by the same reference numeral in the embodiment.

As shown in FIGS. 5A and 5B and FIGS. 6A and 6B, in the embodiment, an alignment mark 30 for electric connection of the element substrate and plural grooves 31 for improving the adhesive properties of the liquid supplying member supplying the liquid to the liquid chamber are formed on the liquid supplying port surface of the top plate 10 (silicon substrate 11), and the alignment mark 30 and the plural grooves 31 are formed simultaneously during the formation of the liquid chamber 15 and the liquid supplying port 16. That is, after the thermal oxide films are formed on the liquid chamber surface and the liquid supplying port surface of the silicon substrate 11 respectively, while the patterning of the liquid chamber pattern is performed on the liquid chamber surface by the photolithography, the patterning of the liquid supplying port pattern is performed on the liquid supplying port surface by the photolithography. At this point, the pattern of the alignment mark 30 for the electric connection and the pattern of the plural grooves 31 for improving the adhesive properties of the liquid supplying member are formed simultaneously. The pattern of the plural grooves 31 is arranged between the adjacent patterns of the liquid supplying port. The silicon substrate 11 in which the patterning has been performed is etched with the etching solution. The etching is started from the liquid chamber pattern 13 on the liquid chamber surface and the liquid supplying port pattern 14 on the liquid supplying port surface in a manner that anisotropically etches the patterned silicon substrate, the etching pierces through the silicon substrate 11, and, as shown in FIGS. 5A and 5B and FIGS. 6A and 6B, the liquid chamber 15 and the liquid supplying port 16 communicated with the liquid chamber 15 are formed. At the same time, the alignment mark 30 for the electric connection and the plural grooves 31 are formed on the liquid supplying port surface of the silicon substrate 11.

Then, after the thermal oxide film of the silicon substrate 11, in which the anisotropic etching is finished, is removed by the wet etching, similarly to the above-described embodiments, the silicon nitride film 19 is deposited on the both surfaces of the silicon substrate 11 and all the faces of the liquid chamber 15 and the liquid supplying port 16, which are formed by the etching.

As described above, in the embodiment, the liquid chamber 15 and the liquid supplying port 16 are formed simultaneously from each side of the substrate, so that the stiffness of the top plate 10 (silicon substrate 11) can be highly maintained and the liquid supplying port pattern can be decreased on the liquid supplying port surface of the silicon substrate 11, which allows the formation of the patterns of the alignment mark 30 and the plural grooves 31. Accordingly, the plural grooves 31 for improving the adhesive properties of the liquid supplying member supplying the liquid to the liquid chamber and the alignment mark 30 for the electric connection can be easily formed between the plural liquid supplying ports 16. In addition to the effects in the above-described embodiments, the liquid supplying member for supplying the liquid to the liquid chamber can be firmly bonded to the liquid supplying port 16 by involving the plural grooves 31, the prevention of the color mixing can be improved, and the electric connection of the element substrate can be easily and precisely connected by using the alignment mark 30 in such a manner that the silicon substrate 11 is used as the top plate 10 and built in the liquid discharge head in the same way as the above-described embodiments.

Further, in the top plate in the liquid discharge head of the invention, since the stiffness can be improved, the warp never occurs in the top plate, the displacement can be prevented in the bonding to the element substrate, and the top plate can be applied to the liquid discharge head in the line shape. That is, since the top plate has the high stiffness and the warp never occurs even in the so-called full line head in which the plural liquid ejecting port are arranged over the recordable region of the recording medium, the displacement can be prevented in the bonding, the degradation of the ejecting performance can be prevented, the stable ejecting characteristics can be obtained without the crosstalk.

What is claimed is:

1. A method of manufacturing a liquid discharge head provided with a discharge port for ejecting a liquid, a discharge energy generating element for ejecting the liquid from the discharge port, and at least one substrate having a liquid supplying port for supplying the liquid to the discharge energy generating element, said method comprising the steps of:

providing a mask for forming the liquid supplying port in the substrate and forming the liquid supplying port by etching;

removing the mask from the substrate in which the liquid supplying port has been formed; and depositing an ink resistant coating integratedly on a surface that was covered by the mask and on all surfaces of the liquid supplying port formed by the etching of the substrate from which the mask was removed.

2. The method of manufacturing a liquid discharge head according to claim 1, wherein the liquid discharge head is provided with a first substrate on which a liquid flow channel wall defining a liquid flow channel for guiding the liquid is formed and a second substrate having one surface on which a liquid chamber for storing the liquid is formed and another surface on which the liquid supplying port is formed;

further comprising the steps of:

forming the liquid chamber and the liquid supplying port at one time on the two surfaces, respectively, of the second substrate; and bonding the first substrate to the second substrate.

3. The method of manufacturing a liquid discharge head according to claim 2, wherein a material of the second substrate is silicon, and the liquid chamber and the liquid supplying port are formed in the second substrate by etching the second substrate.

4. The method of manufacturing a liquid discharge head according to claim 2, wherein a surface crystal orientation of the the second substrate is (100) or (110).

5. The method of manufacturing a liquid discharge head according to claim 2, wherein a plurality of grooves are formed on a liquid supplying port surface of the second substrate.

6. The method of manufacturing a liquid discharge head according to claim 5, wherein a plurality of liquid supplying ports are formed in the second substrate and plural grooves are formed between adjacent liquid supplying ports.

7. The method of manufacturing a liquid discharge head according to claim 5, wherein the plurality of grooves are formed at one time in the second substrate in the step of forming the liquid chamber and the liquid supplying port in the second substrate.

8. The method of manufacturing a liquid discharge head according to claim 2, wherein an alignment mark for electrical connection is formed on a liquid supplying port surface of the second substrate.

9. The method of manufacturing a liquid discharge head according to claim 8, wherein the alignment mark is formed on the second substrate in the step of forming the liquid chamber and the liquid supplying port in the second substrate.

10. The method of manufacturing a liquid discharge head according to claim 2, wherein a movable member is provided on the first substrate and the movable member is located so as to oppose the discharge energy generating element.

11. The method of manufacturing a liquid discharge head according to claim 10, wherein an upward displacement control member which controls upward displacement of the movable member is formed in the liquid flow channel.

12. The method of manufacturing a liquid discharge head according to claim 1, wherein the step of removing the mask from the substrate is executed by wet etching.

13. The method of manufacturing a liquid discharge head according to claim 1, wherein the mask comprises silicon oxide.

14. The method of manufacturing a liquid discharge head according to claim 1, wherein the ink resistant coating comprises silicon nitride.

15. The method of manufacturing a liquid discharge head according to claim 1, wherein the ink resistant coating is formed by a chemical vapor deposition (CVD) method.

* * * * *

UNITED STATES PATENT AND TRADEMARK OFFICE

CERTIFICATE OF CORRECTION

PATENT NO. : 6,908,564 B2
DATED : June 21, 2005
INVENTOR(S) : Shuji Koyama et al.

It is certified that error appears in the above-identified patent and that said Letters Patent is hereby corrected as shown below:

Column 8,
Line 35, “though” should read -- through --.

Column 11,
Line 3, “the the” should read -- the --.

Signed and Sealed this

Third Day of January, 2006

JON W. DUDAS
*Director of the United States Patent and Trademark Office*